United States Patent [19]

Meyer

[11] 4,037,288

[45] July 26, 1977

[54] FILAMENT LIQUID QUENCHING APPARATUS

[75] Inventor: Richard D. Meyer, Greenville, S.C.

[73] Assignee: Phillips Petroleum Company, Bartlesville, Okla.

[21] Appl. No.: 588,559

[22] Filed: June 19, 1975

Related U.S. Application Data

[62] Division of Ser. No. 395,036, Sept. 7, 1973, Pat. No. 3,905,381.

[51] Int. Cl.[2] ..... B08B 3/00; A47L 5/34

[52] U.S. Cl. ..... 15/302; 15/306 A

[58] Field of Search ..... 15/302, 303, 306 R, 15/306 A, 306 B; 425/68, 71; 73/215; 134/9, 15, 64 R, 64 P, 122 R, 122 P

[56] References Cited

U.S. PATENT DOCUMENTS

| | | | |
|---|---|---|---|
| 1,728,471 | 9/1929 | Bratring | 134/15 |
| 2,494,468 | 1/1950 | Boryzkowski | 425/68 X |
| 3,358,980 | 12/1967 | Taylor | 134/122 R X |
| 3,620,230 | 11/1971 | Foret | 15/308 |
| 3,751,756 | 8/1973 | Arnett, Jr. | 15/306 A |

*Primary Examiner*—Christopher K. Moore

[57] ABSTRACT

Melt-spun thermoplastic filaments are liquid quenched in an apparatus equipped with baffles for quieting the surface of said quenching liquid and a weir for maintaining a constant level of quenching liquid. The liquid is removed from said filaments by an apparatus containing an enclosed chamber which is partially defined by a perforated surface over which said filaments pass in contact therewith, said chamber being in communication with a means for removing fluids therefrom.

3 Claims, 7 Drawing Figures

FILAMENT LIQUID QUENCHING APPARATUS

This application is a division of my copending application Ser. No. 395,036 filed Sept. 7, 1973 and now U.S. Pat No. 3,905,381.

BACKGROUND OF THE INVENTION

The invention relates to an apparatus for liquid quenching melt-spun thermoplastic filaments and an apparatus for removing the quenching liquid from the quenched filaments.

In liquid quenching melt-spun thermoplastic filaments it is desirable that the surface of the quenching liquid be in a quiescent state in the area where the freshly spun filaments enter the liquid. Normally, the primary cause of turbulence in the quench tank is not the filaments entering the liquid, but rather the passage of the filaments through the tank and particularly the filaments leaving the liquid. The area where the filaments leave the liquid is usually at the opposite end of the quench tank from where the filaments enter the liquid. However, the turbulence generated by the filaments moving through the tank and leaving the liquid causes waves on the surface of the liquid which travel to the area where the filaments enter the liquid. These waves can splash upon the hot spinning apparatus or spinnerets adversely affecting the uniformity of the filaments and damaging the spinnerets. Also the filaments themselves can be deformed by the direct action of the waves upon them during the quenching process causing irregular drawing of the filaments or the unquenched filaments to fuse together. Consequently to produce uniform liquid quenched filaments it is desirable to maintain the surface of the quenching liquid in a quiescent state.

In addition to problems caused by waves, other problems exist in liquid quenching systems. For example, fluctuation in level of quenching liquid in the quench tank affects the uniformity of the filaments. To reduce this problem the level of quenching liquid is often maintained by using a weir, but due to the meniscus action of most quenching liquids, there is some fluctuation in the quenching liquid level even though a weir is used.

Another problem encountered in liquid quenching systems is removing the liquid from the filaments after the filaments have been quenched. A number of methods have been developed to remove the quench liquid from the filaments, but frequently they abrade, cut or otherwise damage the filaments or affect their uniformity.

It is an object of the invention to provide apparatus to liquid quench melt-spun thermoplastic filaments.

Another object of the invention is to provide a quench tank with a quiescent liquid surface.

Still another object of the invention is to provide a quench tank with a weir which minimizes the meniscus effect of the quenching liquid on the level of quenching liquid in the tank.

Yet another object of the invention is an apparatus for removing quenching liquid from the filaments without damaging or affecting the uniformity of the yarn.

SUMMARY OF THE INVENTION

In accordance with the invention there is provided apparatus for liquid quenching melt-spun thermoplastic filaments comprising, in combination: a quench tank containing baffles to calm the quench liquid; a weir located in a quiescent area to minimize the meniscus action of the quench liquid and to maintain a constant level of quench liquid in the quench tank; and an apparatus for removing the quench liquid from the filaments.

Further according to the invention there is provided an assembly useful for removing liquid from the filaments comprising, in combination: a chamber which contains perforations in a surface over which filaments pass in contact therewith and a means in communication with said chamber for removing fluids therefrom.

DETAILED DESCRIPTION OF THE INVENTION

Figure 1:
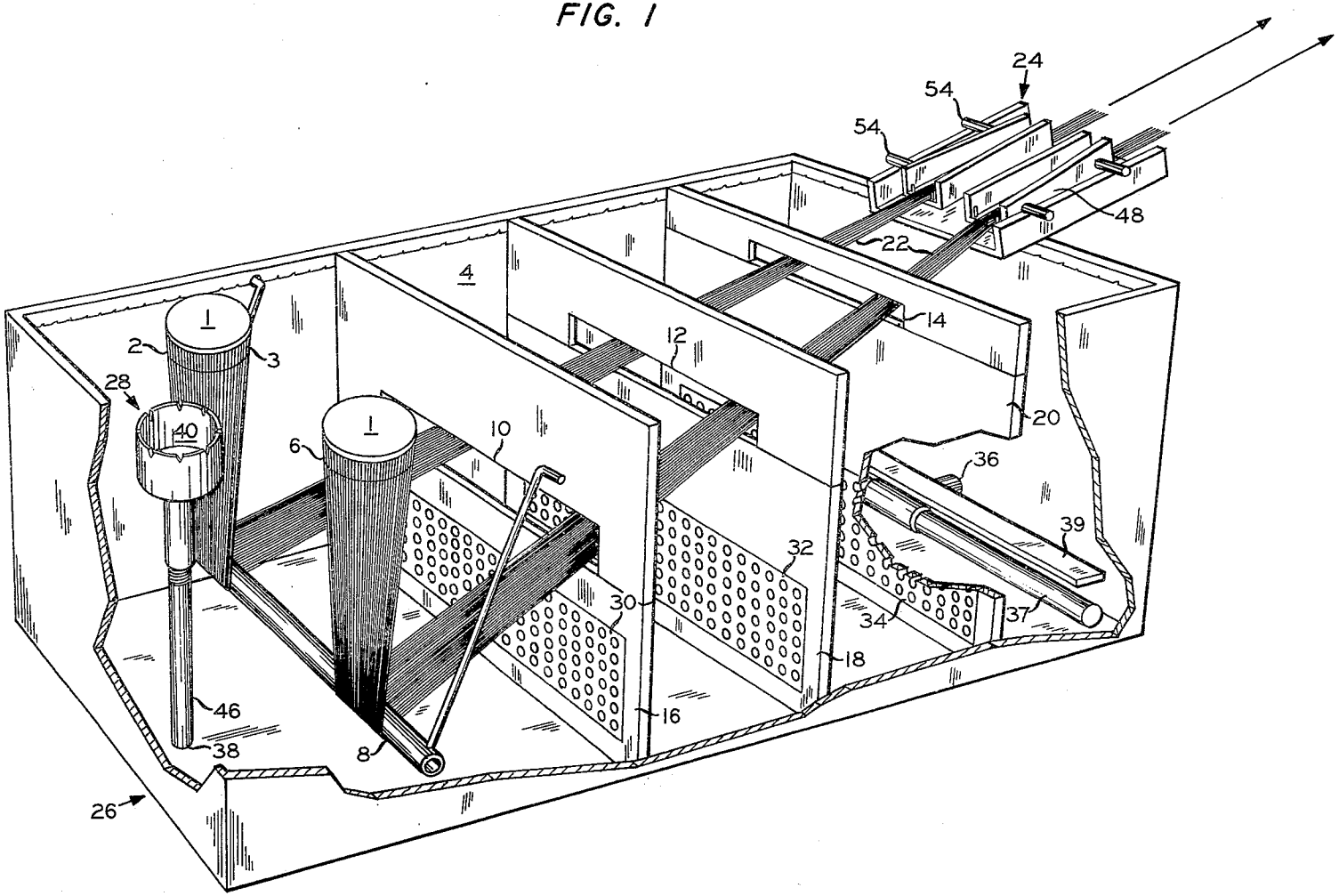
FIG. 1 is a diametric view, partly cut away, of a combined apparatus in accordance with the invention.

Referring now to the drawings wherein like reference numerals are employed to denote like elements, the invention will be more fully explained. FIG. 1 illustrates a combination of the invention wherein thermoplastic filaments 2 are extruded through spinnerets 1. As the filaments 2 leave the surface of the spinnerets 1, they pass through air for a distance 3 or some other gaseous atmosphere prior to entering the quench liquid. Since the quench liquid is normally considerably cooler than the temperature of the spinnerets 1, the quench liquid must not contact the spinnerets or damage to the spinnerets may result. The filaments 2 then pass into the quench liquid 4 a point 6. The filaments 2 pass through the liquid over a guide means 8 through slots 10, 12 and 14 in the baffles 16, 18 and 20 respectively. The filaments 2 pass out of the quench liquid 4 at point 22 and through quench liquid removal means generally denoted by reference numeral 24 and onto further processing.

The quench liquid 4 is contained in a tank, generally denoted by reference numeral 26. The tank 26 is equipped with a weir, generally denoted by reference numeral 28 to control the level of quench liquid in the tank within a narrow range. Quench liquid enters the tank through conduit 36 and perforated conduit 37 and exits the tank through opening 38 after it spills into weir pot 40. A baffle 39 is provided above perforated conduit 37 to minimize turbulence due to the incoming quench liquid. The liquid 4 can be recirculated and conditioned if desired or it can be discarded after it passes through the tank. Frequently where water is used as the quenching liquid, tap water is fed to the tank and discarded after passing through outlet 38. The liquid 4 can pass freely through the perforated sections 30, 32 and 34 in baffles 16, 18 and 20 respectively.

Figure 2:
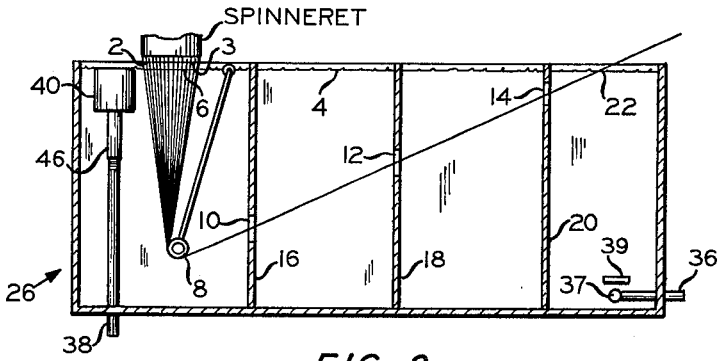
FIG. 2 is a sectional view of the quench tank of FIG. 1 showing the baffles and the path of the filaments through the quench tank.

FIG. 2 illustrates the path of filaments 2 through the liquid 4. The distance the filaments travel from the surface of the spinnerets to the quench liquid, denoted by numeral 3, varies with the particular process, but it is usually in the range of from 1/16 to 2½ inches.

Figure 3:
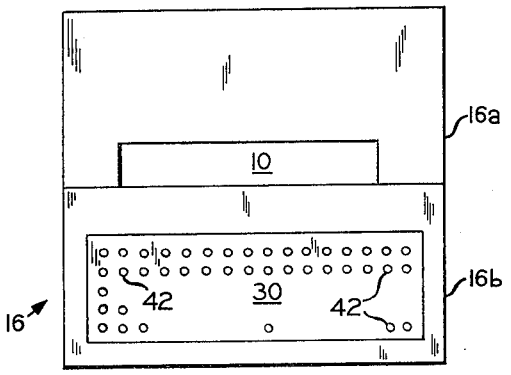
FIGS. 3, 4 and 5 are elevation views of the baffles of FIGS. 1 and 2 showing cutouts for the filaments and perforated areas for quench liquid circulation.

As shown in FIG. 3, opening 10 is large enough for the filaments to pass through it without touching the baffle. The perforated section 30 is located in the lower porton of the baffle 16*b*. The apertures 42 therein and the perforated section itself 30 are of sufficient size to permit adequate circulation but minimize turbulence of the quench liquid. It is within the scope of the invention that the entire baffle be perforated and also that the perforated section be constructed such that it is removable so that a new perforated section with different size apertures can be installed. It is suggested that the tank 26 be constructed such that baffles 16, 18 and 20 are removable. In addition for most convenient operation, the lower portion of baffles 16, 18 and 20 designated by reference numerals 16*b*, 18*b*, and 20*b* respectively can be separable from the upper portion of said baffles designated by reference numerals 16*a*, 18*a* and 20*a* respectively. This allows for simplification during startup in that the upper portion of said baffles are removed until the line is in operation, thus eliminating the need to thread the filaments through the holes in the baffles. Although successful results have been obtained using three baffles in the tank, it is understood that the invention is not limited to three baffles. The baffles are used to produce a calm surface in the area where the filaments enter the quench liquid, reference numeral 6, and depending on the particular quench liquid, lineal speed of the filaments etc., one or more baffles may be required.

Figure 4:
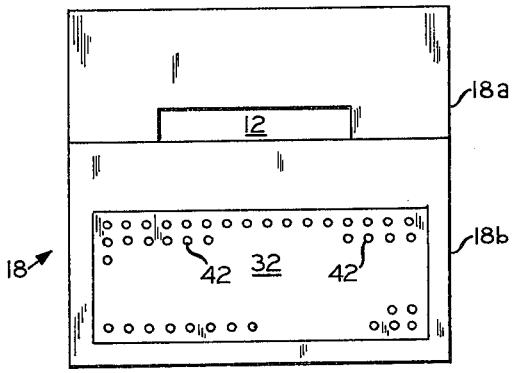

As shown in FIG. 4, baffle 18 is nearly identical to baffle 16 except that the opening 12 for the filaments is located nearer the surface of the quench liquid. The perforated section 32 and the aperture 42 therein are of sufficient size to permit circulation but to minimize turbulence of the quench liquid.

Figure 5:
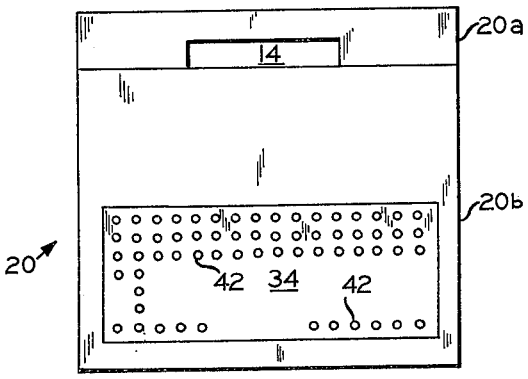

As shown in FIG. 5, filament opening 14 of baffle 20 is progressively nearer the surface of the quench liquid as compared with baffles 16 and 18. The perforated section 34 with the apertures 42 therein are of sufficient size to permit circulation but to minimize turbulence of the quench liquid.

The apertures in baffles 16, 18 and 20 are normally smaller in size the nearer the baffle is to the spinnerets 1. This tends to dampen the movement of the quench liquid 4 through the tank 26. Also deepening the tank in the area where the filaments leave the quench liquid 22 tends to dampen the movement of the quench liquid through the tank. In fact, it may be possible to remove all but one baffle nearest the spinnerets 1, if the tank is large enough. Normally, however, plant space is limited and relatively small tanks are required, thus making it desirable to use two or more baffles.

Figure 6:
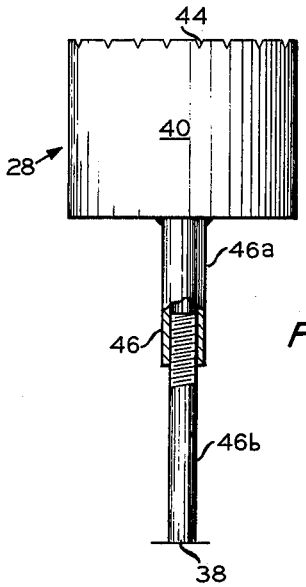
FIG. 6 is an elevation, partly cut away, of the weir of FIG. 1.

Referring to FIG. 6, to minimize the meniscus action of the quench liquid, notches 44 are cut into the upper rim of the weir. It is preferred to mill the notches for uniformity and thus better control of the liquid lever in the tank. It is desirable to construct the weir in such a manner that it can be raised or lowered to adjust the liquid level in the tank and thus vary the distance of the liquid from the spinneret. One such method is to construct the weir standpipe 46 in two sections. The upper section 46*a* is threaded inside and the lower section 46*b* is threaded outside in order to receive the upper section 46*a*. It is important to insure that the weir is level for proper weir action. The weir notches 44 can vary widely in width, depth, shape and distance apart, but generally they are in the range of 1/16 to ½ inches wide, 1/16 to ½ inches deep, *v* or *u* shaped and ½to 3 inches apart. The weir should be placed in the most quiescent section of the tank; in FIG. 1 that would be in the area nearest the spinnerets 1. Also another suitable location for the weir is between baffles 16 and 18. The weir can be constructed in any suitable shape; however, the round shape minimizes the creation of turbulence in the quiescent zone during adjustment of the weir height, when such adjustment is made by turning the weir.

Figure 7:
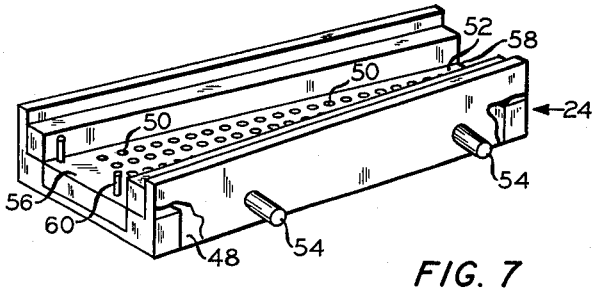
FIG. 7 is a diametric view, partly cut away, of apparatus used to remove the quench liquid from the filaments.

Referring to FIG. 7, the filament quench liquid removal means comprises a chamber 48 having apertures 50 located in the upper portion 52. It is recommended that the apertures 50 be located so that they cover the entire width of the upper portion 52 in order that all of the filaments will pass over at least some of the holes. The chamber 48 is provided with openings 54 for connection to a vacuum means (not shown) for removing quench liquid, air or other fluids from chamber 48. The size of apertures 50 are normally in the range of from 1/64 to ⅛ inches in diameter and ⅛ to ½ inches spaced apart. The apparatus 24 can be tapered from the inlet 56 to the outlet 58 to conform the upper portion 52 to the shape of the filament tow passing over said portion. Also inlet guides 60 are provided at the inlet 56 of said apparatus.

EXAMPLE

Polypropylene filaments were melt-spun through two spinneret heads and water quenched using an apparatus according to the invention.

The quench tank was 58½ inches long and 34 inches wide. The depth of the tank was 30 inches for a distance of 37½ measured from the spinneret end and then the bottom was sloped upward 40° from horizontal. The tank at the sloped end had a minimum depth of 12 inches.

In general, the greater the volume of quench liquid in the tank, less turbulence is transmitted and thus fewer baffles are required. The above apparatus was constructed with a sloping bottom due to space limitation and it was not the preferred design.

The baffles corresponding to baffles 20, 18 and 16 of FIG. 2 were spaced 15, 16 and 38 inches, respectively, measured from the end where the filaments leave the quench liquid. The baffle corresponding to baffle 20 was 33¾ inches wide and 25 inches deep. The perforated area was 29¾ inches wide, 12 inches deep, centered on the baffle 2 inches from the bottom and had 0.250 inches holes on 5/16 inch centers providing 58 percent open area. The tow opening was 14 inches wide, 2½ inches deep and centered on the baffle 2½ inches from the top.

The baffle corresponding to baffle 18 was 33¾ inches wide and 30 inches deep. The perforated area was 29¾ inches wide, 12 inches deep, centered on the baffle 2 inches from the bottom and had 0.125 inches holes on 3/16 inches centers providing 40 percent open area. The tow opening was 18 inches wide, 3 inches deep and centered on the baffle 7 inches from the top.

The baffle corresponding to baffle 16 was 33¾ inches wide and 30 inches deep. The perforated area was 29¾ inches wide, 10 inches deep, centered on the baffle 2 inches from the bottom and had 169 0.045 inches holes per square inch providing 27 percent open area. The tow opening was 24 inches wide, 4 inches deep and centered on the baffle 12 inches from the top.

The weir was 6 inches diameter with ¼ inch deep notches spaced 2 inches around the top. The weir was positioned between baffles corresponding to baffles 16 and 18 of FIG. 2.

The quench liquid removal means comprised two troughs as illustrated in FIGS. 1 and 7. Each trough had an inlet width of 3 inches and tapered to 1 inch at the outlet end. The holes in the bottom plates were 1/16 inch in diameter and as close as possible.

The quench liquid was water and the bath temperature was maintained at approximately 116° F. The spinnerets were operated at a distance of between 1⅜and 1/16 inches from the surface of the quench liquid. The vacuum on the quench liquid removal means varied between 3 and 5 inches of water. The tow denier for both spinnerets was 438,000 with a line speed of from 266 to 300 feet per minute.

The above-described apparatus provided a quiescent quench liquid surface in the area of the spinnerets to the extent that the spinnerets could be operated continuously within 1/16 of an inch of the quench liquid. Also it is noted that in the area where the filaments were leaving the quench liquid, waves over 1 inches were being produced. In addition the filaments leaving the quench liquid removal means were not cut or damaged and were dry to the touch.

What is claimed is:

1. Apparatus for removing liquid from filaments comprising:

a longitudinal chamber wherein a plurality of apertures are located in a substantially flat surface of said chamber over which said filaments are passed parallel to the lengthwise dimension of said chamber and in contact therewith and a means in communication with said chamber for removing fluids therefrom:

a liquid quench tank positioned immediate the longitudinal chamber comprising a tank for storing a quench liquid;

at least one baffle in said quench tank to dampen the movement of quench liquid wherein said baffle contains an opening through which said filaments pass and a perforated area to permit circulation of said quench liquid but which reduces turbulence of said quench liquid;

means for guiding said filaments through said tank; and a weir to control the level of quench liquid in said tank.

2. The apparatus of claim 1 wherein the plurality of apertures are circular holes ranging from about 1/64 inch to ½ inch in diameter and the centers thereof are spaced apart a distance ranging from ⅛ inch to ½ inch.

3. The apparatus of claim 1 wherein the plurality of apertures are ¼ inch holes on 5/16 inch centers.

* * * * *

UNITED STATES PATENT AND TRADEMARK OFFICE

CERTIFICATE OF CORRECTION

PATENT NO. : 4,037,288

DATED : July 26, 1977

INVENTOR(S) : Richard D. Meyer

It is certified that error appears in the above-identified patent and that said Letters Patent are hereby corrected as shown below:

Column 6, line 21, delete "1/2" and insert -- 1/8 --.

Signed and Sealed this

*Thirteenth* Day of *June 1978*

[SEAL]

*Attest:*

RUTH C. MASON
*Attesting Officer*

DONALD W. BANNER
*Commissioner of Patents and Trademarks*